United States Patent [19]

Light

[11] 4,188,852

[45] Feb. 19, 1980

[54] TUNING SYSTEM FOR TIMPANI

[76] Inventor: Walter J. Light, P.O. Box 4403, Sante Fe Station, Denver, Colo. 80204

[21] Appl. No.: 835,365

[22] Filed: Sep. 21, 1977

[51] Int. Cl.[2] ..... G10D 13/02; G10D 13/04

[52] U.S. Cl. ..... 84/411 A; 84/419

[58] Field of Search ..... 84/411 R, 411 A, 419, 84/413

[56] References Cited

U.S. PATENT DOCUMENTS

| | | | |
|---|---|---|---|
| 674,550 | 5/1901 | Zeidler | 84/411 R |
| 835,173 | 11/1906 | Agne | 84/419 |
| 2,172,578 | 9/1939 | Gladstone | 84/411 R |
| 2,173,443 | 9/1939 | Schuman | 84/411 A |
| 2,587,310 | 2/1952 | Goodman | 84/419 |
| 3,646,843 | 3/1972 | Kregal | 84/419 |
| 3,685,389 | 8/1972 | Bemben | 84/411 R |

*Primary Examiner*—Lawrence R. Franklin
*Attorney, Agent, or Firm*—John E. Reilly

[57] ABSTRACT

A tuning system has been devised for timpani and similar percussion instruments of the type having a removable head or skin positioned across the upper end of a sound chamber and terminating in an outer edge surrounding the upper circular edge of the chamber with a hoop or other suitable bead affixed around its outer edge. In order to facilitate ease of replacement of the head, a hoop retainer is provided with open-throated connectors at spaced circumferential intervals each adapted to receive the upper enlarged end of a tuning post assembly which forms a part of each of a series of tuning units comprising the tuning system. Each tuning post assembly is so constructed and arranged as to permit simultaneous adjustment through a common chain drive to loosen or tighten the head in order to change its pitch; and further to permit individual vertical adjustment of each tuning post assembly to effect localized changes in pitch by loosening or tightening the head in the area adjacent to that tuning unit. In either case, tightening or loosening of the head is effected through the vertical adjustment of the post assembly in causing the enlarged cap to bear against the hoop connector under varying degrees of pressure; and at the same time, the cap is so positioned within the slotted hoop connector as to permit quick disconnection simply by loosening of the caps a sufficient distance to raise them above the surface of the connectors whereupon the hoop receiver and associated connectors can be twisted and removed from engagement from the tuning units followed by replacement of the head.

14 Claims, 5 Drawing Figures

TUNING SYSTEM FOR TIMPANI

This invention relates to percussion instruments and more particularly relates to a novel and improved tuning system for percussion instruments, being specifically adaptable for use with timpani, kettle drums and the like.

BACKGROUND OF THE INVENTION

The development of kettle drums, or timpani, can be traced back to early Egyptian times. Even the early kettle drums in use over a hundred years ago consisted generally of a copper bowl or body provided with a head or skin composed of various selected leather materials. In order to regulate the pitch or degree of tightness of the skin, typically a ring affixed to the outer surrounding edge of the skin would be secured to the body by screws and, by turning the screws the skin could be more or less strained resulting in higher or lower notes, respectively. The body itself would rest on a suitable pedestal or stand.

The tuning of kettle drums over the years however has always been considered to be a difficult task and connected with a considerable loss of time. For this reason composers were often compelled to permit the timpani player a certain number of bars rest whenever a change of pitch was required. It became the practice for the player to employ only the two or three fastening screws nearest to him for tuning, as a result of which the outer ring would get out of position, the tension of the skin would be uneven, and different notes would be given near the different fastening screws. Thus, several approaches were conceived for constructing an instrument such that the tension of the skin could be affected evenly around the ring by one single turning of the hand. Among the various approaches that have been proposed in the past are a system of levers connected with the ring that secures the skin; also, a revolving kettle drum which is tuned by turning the main body or bowl to the right or left. Tuning mechanisms have been employed which were located either interiorly of the drum or underneath the body of the drum, such as, by the use of a pedal control in order to avoid tuning by hand. Typical pedal mechanisms consist of a lever which has at one end a shoe and a heavy club or ball and at the other end a shaft with a so-called eccentric which presses upon a lever with a bolt in the middle by which the plate is moved. By moving the pedal downwardly to raise the pitch, or upwardly to lower it, it can then be pressed sidewise to fall into a tooth of a rack so as to fix it in place. Typically, the rack would be provided with a dial and pointer associated therewith to indicate whether the desired pitch has been reached. Nevertheless the foregoing approaches did not successfully overcome the problem of selected tuning at different individual points along the surface of the stem. For instance, a major difficulty in employing separate tuning screws which are fixed directly to the outer ring securing the head or skin is the time and labor required for changing or replacement of the head. In the past this has necessitated individual removal of each screw before the head and outer ring or flesh hoop could be removed and replaced. Accordingly, there is a demonstrated need for a tuning system for timpanis and the like which permits accurate tuning of the head or skin by uniform stretching over the entire surface, individual tuning at different locations along the skin for playing different notes while at the same time incorporating the collective and individual tuning units into a single assembly which is removably but positively secured at selected intervals along the outer edge of the head so as to facilitate ease of replacement of the head.

SUMMARY OF THE INVENTION

Accordingly, it is an object of the present invention to provide for a novel and improved tuning system for percussion instruments; and further to provide a tuning system which will obviate difficulties formerly associated with tuning and replacement of the head or skin of a timpani as well as like types of percussion instruments.

It is a further object of the present invention to provide for a novel and improved tuning system comprised of a series of tuning units removably secured to a hoop retainer for the head of the percussion instrument in order to allow the player to tune the instrument easily and allow each tuning unit to travel exactly the same distance in the course of adjustment so as to draw the head down evenly at all times and to insure clear pitch and resonance in tuning.

It is another object of the present invention to provide a tuning system for timpanis and the like characterized by having a series of tuning units removably secured to the outer hoop retainer for the head or skin of the timpani with means drivingly interconnecting the tuning units to permit simultaneous adjustment of the tuning units in affecting a change in pitch and further to permit simultaneous loosening and disconnection of the tuning units from the hoop retainer when it is desired to remove and replace the head; and still further wherein each tuning unit provides means for independent adjustment of each tuning unit with respect to the other tuning unit in fine tuning the head at localized areas around the timpani.

In accordance with the present invention, a preferred form of tuning system is conformable for use with various percussion instruments specifically adaptable for use with timpanis in which the timpani or kettle drum is generally characterized by having an upper removable head stretched across the upper end of the sound chamber so that the pitch of the instrument can be determined by the degree of tightening of the head with respect to the chamber, and the head having its outer peripheral edge attached to an outer ring-like member commonly referred to as a flesh hoop. A hoop retainer is placed over the outer flesh hoop and is provided with slotted post-receiving openings at spaced circumferential intervals to receive the upper enlarged cap of a tuning post assembly associated with each tuning unit of the system. A main frame or support on each tuning unit is permanently affixed to the body or bowl of the drum and is provided with upper and lower spaced bushing members to support the tuning post assembly.

In the preferred form, each tuning post assembly has upper and lower telescoping post members, the upper post member being provided with a drive sprocket in order to rotate the post by means of a common chain drive trained over the sprocket of each of the upper turning posts and which rotation will cause the upper post to be vertically adjusted with respect to the lower post member. This vertical adjustment or movement of the post is transmitted into the head through the enlarged cap on the upper post which bears against the slotted post-receiving opening. The separable connection between the cap and post-receiving opening is such that the hoop retainer can be easily removed without disassembly of the tuning units simply by lifting or raising the upper tuning posts to an extent such that the cap clears the upper surface of the post-receiving openings whereupon the hoop retainer can be twisted away from alignment with the tuning unit and removed from the drum followed by removal of the head. When the replacement head is positioned on the drum, the post-receiving openings are returned into alignment with the cap and the caps evenly tightened by operating any one or two of the tuning posts to rotate the chain drive. This is done through manipulation of a turning handle which has an Allen wrench insertable into a socket in the upper end of each cap to effect turning or rotation of one or a pair of the turning posts.

In addition, the lower post member of each unit is characterized by being fixed against rotation while being vertically adjustable to cause independent raising and lowering of the turning post either to loosen or tighten the head at that location without adjusting the other posts. This can be accomplished by a turning nut engageable with external threading on the lower post while fixing the post against rotation so that threading of the nut will impart axial movement to the post which is transmitted into the upper turning post.

BRIEF DESCRIPTION OF THE DRAWINGS

Other objects, advantages and features of the present invention will become more apparent as the detailed description proceeds taken in conjunction with the accompanying drawings, in which.

DETAILED DESCRIPTION OF THE PREFERRED EMBODIMENT

Figure 1:
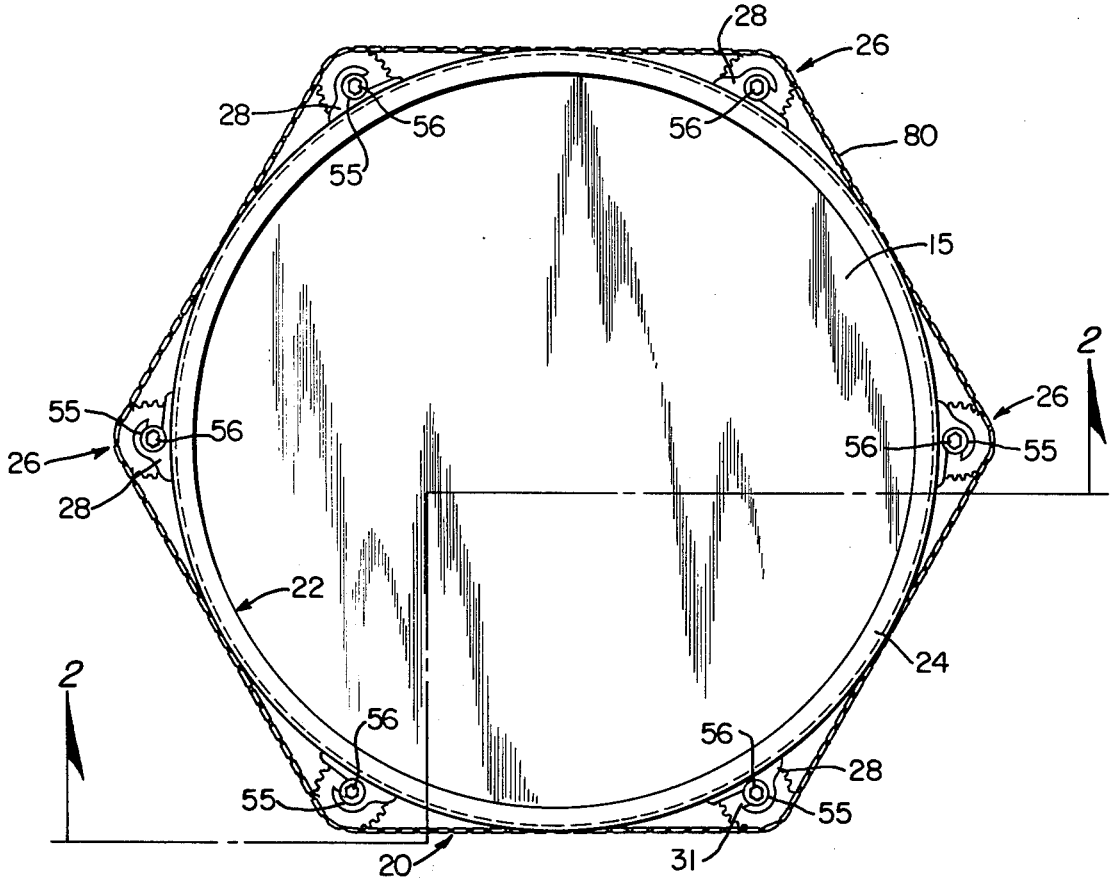
FIG. 1 is a top plan view of a timpani and tuning system therefore in accordance with the present invention.
Figure 2:
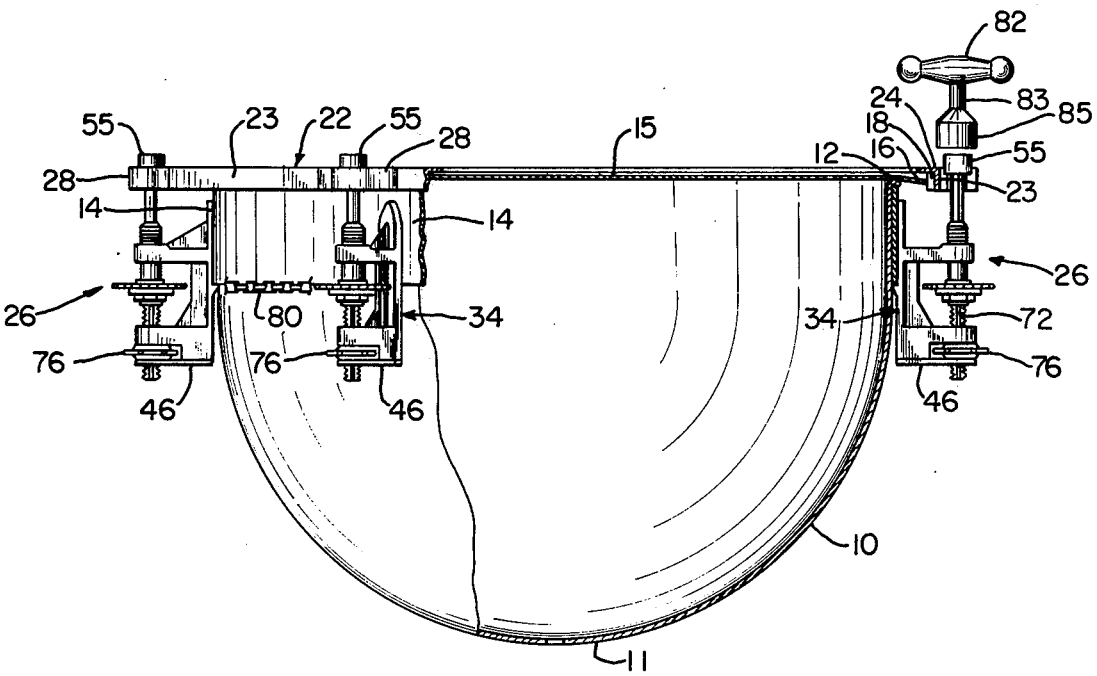
FIG. 2 is a front elevational view with portions in sections of the preferred form of invention shown in FIG. 1.
Figure 4:
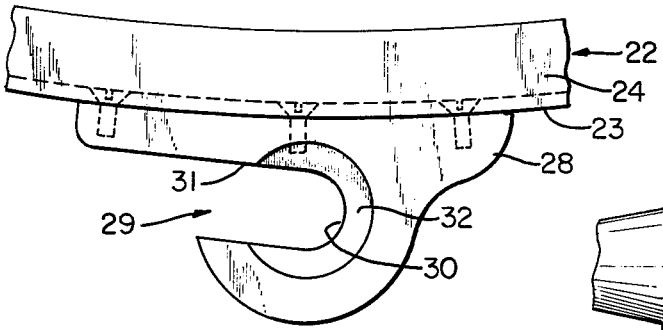
FIG. 4 is a plan view in detail of a preferred form of a tuning post receiver.
Figure 5:
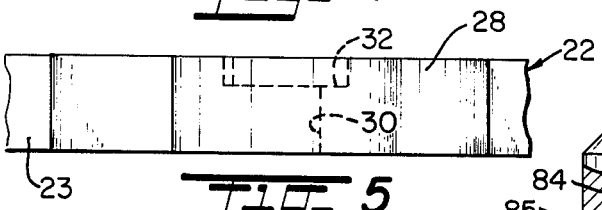
FIG. 5 is a front view in elevation of the tuning post receiver as shown in FIG. 4.
Figure 3:
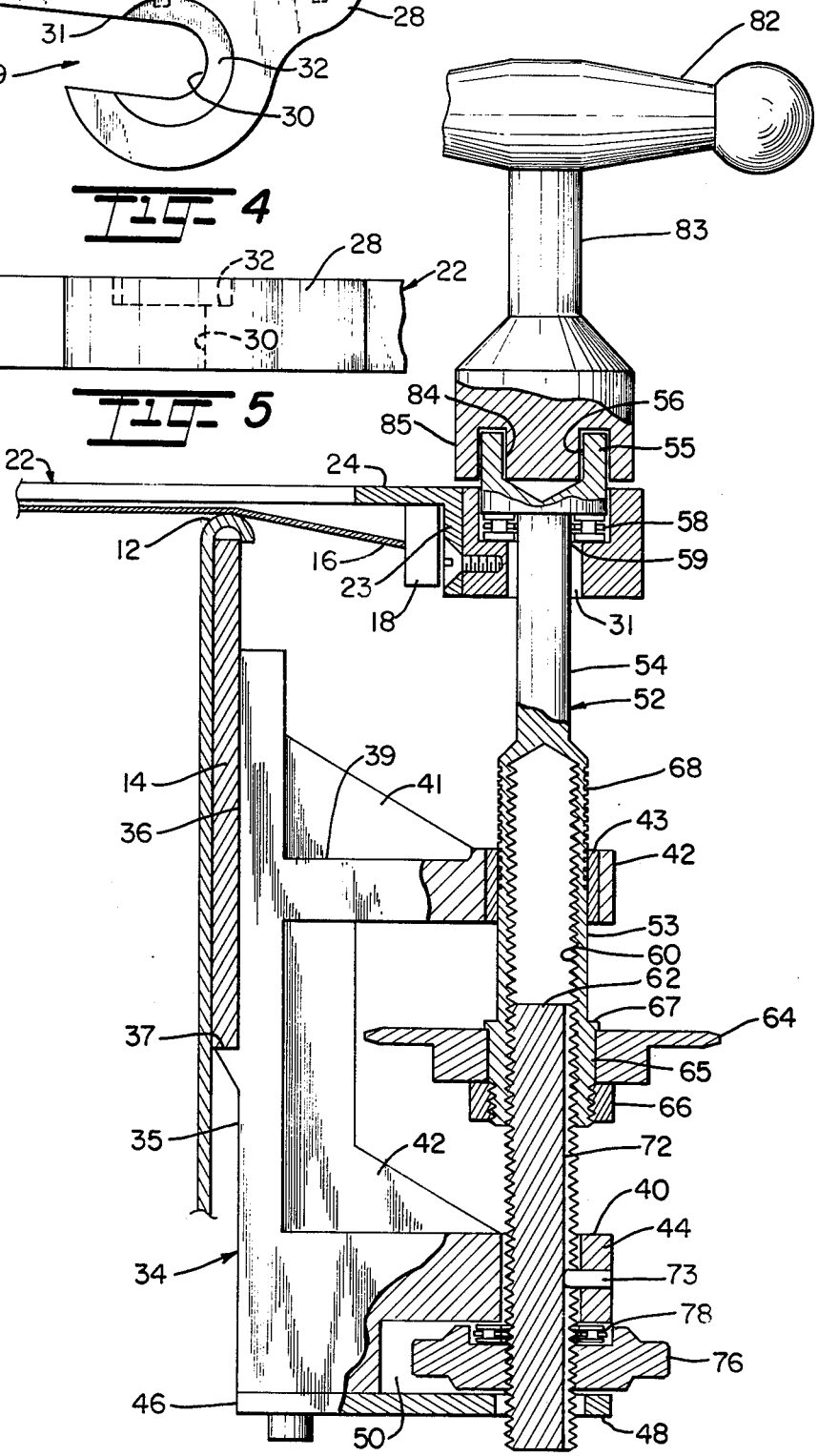
FIG. 3 is a view partially in section of one of the preferred tuning units in accordance with the present invention.

Referring in detail to the drawings, there is shown by way of illustrative example in FIGS. 1–4 a preferred form of tuning system as it would be associated with a timpani or kettle drum. However, from the description that follows it will be evident that the tuning system is readily conformable for use with other percussion instruments, particularly those of the type which employ a sound chamber having a head or skin stretched across one end of the chamber and where the pitch or tuning can be regulated by the amount of tension applied to the head or skin. In accordance with well-known practice, conventional timpani or kettle drum parts include a pedestal or stand, not shown, for a bowl 10 which defines a sound chamber, the bowl being of generally hemispherical configuration having a lower closed end portion 11 and an upper open end in the form of an outer surrounding edge or rim having a reverse curved portion 12. An outer steel retaining ring 14 surrounds the external surface of the bowl adjacent to its upper edge 12, and a head or skin 15 extends across the upper open end, overlapping the reverse curved portion 12 and being affixed at its outer perimeter 16 to a band or flesh hoop 18. It will be appreciated that tuning of the drum is accomplished by regulating the amount of tension applied to the head 15 specifically by stretching the head downwardly past the upper surrounding edge 12. Generally, the size of the bowl is such that the diameter across the upper open end is on the order of 19"–36" and it will be therefore apparent that the pitch or tuning of the drum may be varied by tension applied uniformly around the outer perimeter of the skin; or tuning may be effected by stretching the head at a localized point or area along the outer perimeter of the drum.

In accordance with the present invention, a preferred form of tuning system 20 is so constructed and arranged as to permit the timpani player to tune or change the musical pitch of the instrument uniformly across the entire surface of the drum and in such a way as to assure clear pitch and resonance as well as to effect localized tuning at preselected points along the outer periphery of the head. Moreover, the tuning system is mounted in relation to the head in such a way as to facilitate rapid replacement of the head without necessity of disassembly of any of the parts comprising the tuning system itself and in fact requiring removal only of the unitary hold-down member interpositioned between the tuning system and head. To this end, a preferred form of unitary hold-down member comprises a ring-like hoop receiver 22 which is of generally inverted L-shaped configuration and provided with a vertical band 23 and horizontal band 24 interconnected at right angles to the vertical band and dimensioned to extend over the hoop 18 with the vertical band 23 in closely surrounding relation to the hoop. In order to releasably interconnect each of a plurality of tuning units 26 to the hoop receiver, a corresponding number of open-throated hoop connectors 28 are positioned at equally spaced circumferential intervals to the hoop receiver and are permanently affixed to the vertical band 23 of the hoop receiver so as to project in an outward radial direction therefrom. Each connector 28 is slotted as at 29 to define a central opening 30 and an entrance 31, the entrance extending in a generally tangential direction in relation to the outer peripheral edge of the hoop or hoop receiver. In addition, the upper edge of the connector surrounding the central opening is counterbored to define an annular enlarged recess 32 in surrounding relation to the central opening.

Each tuning unit is broadly comprised of a main casting or frame 34 having an elongated relatively narrow plate 35 provided with a generally concave inner surface portion 36 which conforms to the curvature of the steel retaining ring 14, and the plate 35 is permanently affixed to the steel retaining ring so that its longer dimension extends in a vertical direction. A ledge 37 is formed for inward extension from the inner surface 36 of the plate and adapted to bear upwardly against the bottom edge of the retaining ring 14 when the main casting is affixed thereto. The main casting also includes upper and lower spaced arms 39 and 40, respectively together with reinforcing flanges 41 and 42. The upper arm 39 terminates at its outer free end in a bushing 42 which is adapted to receive a needle bearing insert 43. In turn, the lower arm 40 terminates in an outer free end in the form of a bushing 44 in coaxial spaced relation beneath the upper bushing 42. The main frame is completed by a bottom retainer plate 46 which is affixed to the undersurface of the frame 34 to project outwardly therefrom and to terminate in an outer free end 48 which also defines a bushing spaced vertically beneath and axially aligned with the bushings 42 and 44. Moreover, the bottom retainer plate 46 forms with the underside of the arm 40 a radially extending recessed portion 50 for a purpose to be hereinafter described.

A main tuning post assembly for each tuning unit is made up of a main tuning post or shank 52 which includes a lower enlarged hollow cylindrical portion 53 journaled in the needle bearing insert 43. An upper elongated shank portion 54 of reduced diameter in relation to that of lower cylindrical portion 53 terminates at its upper end in an enlarged cap 55 having an upwardly facing socket portion 56 adapted to receive an allen wrench. A three-piece thrust bearing 58 generally in the form of annular metal washers is positioned directly behind or beneath the enlarged allen cap 55, the bearing washers being loosely retained beneath the head 55 by a suitable ridge or protuberance 59 on the surface of the post portion 54 while being freely rotatable with respect to the post. The lower enlarged cylindrical portion 53 is internally threaded at 60 to threadedly receive an externally threaded rod or lower post member 62. In addition, a drive member in the form of a sprocket 64 is positioned on an external shoulder 65 adjacent to the lower extremity of the lower cylindrical portion 53, the sprocket being fixed for rotation with the cylindrical portion between a jam nut 66 and a collar stop 67 at the upper end of the shoulder 65. The lower cylindrical portion 53 is further characterized by having a series of vertically spaced annular grooves 68 on its external surface, the grooves defining alignment marks which for instance may be spaced in increments of 1/16" apart to serve as a means of calibrating or tuning the unit in a manner to be described.

The threaded adjustment rod 62 is dimensioned to be of a length to extend or project downwardly from the lower end of the portion 53 through the bushing members 44 and 48 and is provided with an axially extending slot or keyway 72 which is adapted to receive a pin 73 extending radially inwardly through the outer wall of the bushing 44 so as to prevent turning or rotation of the rod. A manual adjustment nut 76 is positioned adjacent to the lower end of the rod and is received in the slotted or recessed portion 50 together with a two-piece thrust bearing 78 which is interposed between the adjustment nut 76 and underside of the bushing 44. Rotation of the nut 76 will cause axial movement of the rod 62 and since the rod is prevented from turning from the pin 76, such axial movement will be imparted to the upper main post assembly 52 to correspondingly move the upper enlarged cap 55 in a vertical direction. It will be apparent that the nut may be rotated in opposite directions in order to reversibly drive the main post assembly up or down with respect to the main casting and hoop receivers.

An important feature of the present invention resides in the cooperative disposition of the upper end cap 55 with respect to each open-throated connector 28. Here it will be seen that the cap can be raised a sufficient distance for the thrust bearings 58 on the underside of the cap to clear the upper surface of the hoop connector so that the post 54 can be laterally inserted through the entrance 31 into the central opening. Downward vertical adjustment of the post assembly then will cause the underside of the cap and thrust bearings to advance into the counterbored portion and to bear against the upper surrounding edge of the opening 30 so as to be securely retained in place by the connector against accidental lateral displacement.

The sprockets 64 on the tuning unit are adapted to receive a common chain drive 80 which traverses the entire outer periphery of the tuning system as illustrated in FIG. 1. As indicated earlier, each upper enlarged cap 55 is adapted to receive an allen wrench and this may suitably take the form of a turning handle 82 having a downwardly projecting stem 83 terminating in a wrench 84 with an outer surrounding ring-like portion 85. When the wrench is inserted into the socket portion and turned in either direction, it will impart corresponding rotation to the upper post assembly 52 and cause the post to be threadedly advanced in either direction with respect to the rod 62. Accordingly, the individual tuning units may be rotated in unison to cause advancement of the main tuning post assemblies a corresponding distance in response to the chain drive 80 which will impart rotational movement from one of the post assemblies to the sprockets of the other post assemblies.

Preferably, a series of fixed tuning units are positioned at equally spaced circumferential intervals around the outer periphery of the bowl. When it is desired to replace the head 15, it is necessary merely to turn one or two of the tuning units by engaging the enlarged cap 55 of each with a turning handle and turning in a clockwise direction, assuming that the thread set between the rod and lower cylindrical portion are right-handed. Turning of one cap will correspondingly advance all of the post assemblies until the caps have cleared the hoop connectors. The hoop receiver is then free to be twisted or turned to advance the connectors away from engagement with the tuning unit, whereupon the hoop receiver may be removed from the drum. The hoop and connector pin may then be replaced followed by replacement of the hoop receiver and turning the hoop connectors back into alignment with the raised caps 55. Rotation of the turning handles in the opposite direction will then cause the caps to be lowered into secure engagement with each connector. As each cap and tuning post assembly is lowered, the degree of tuning or pitch change can be simultaneously regulated, and the alignment marks 68 will enable the player to determine that each tuning post assembly has been lowered to the same point. Of course if finer tuning is desired, or tuning is desired at the localized areas, this is achieved by individual turning of the adjustment nuts 76 associated with each tuning unit.

It will be evident from the foregoing that the features of the present invention are readily conformable for other percussion instruments which require tuning and/or replacement of a head in the manner described. Of course, it is to be understood that various modifications and changes may be made in the specific construction and arrangement of elements of the present invention without departing from the spirit and scope thereof.

I claim:

1. In a percussion instrument of the type having an upper removable head stretched across the upper end of the outer wall of said percussion instrument defining a sound chamber in which the pitch of said percussion instrument is determined by the degree of tightening of said head with respect to said sound chamber, said head having its outer peripheral edge attached to an outer ring-like member, the improvement comprising:

hold-down means associated with said outer ring-like member adjustable to control the extent of tightening of said head, said hold-down means including slotted post-receiving openings at spaced circumferential intervals around said ring-like member;

a tuning system including a plurality of tuning units corresponding to the spacing and location of said post-receiving openings, each tuning unit having a stationary frame including post-supporting means thereon and a tuning post assembly adjustably mounted on said post support means and having an enlarged cap portion thereon, said assembly having a plurality of upper and lower post members, each upper post member operatively engaged by a respective lower post member, each said upper post being laterally insertable into a post-receiving opening with said cap received in an enlarged slot communicating with said post-receiving opening and being independently rotatable with respect to said lower post, said tuning post support assembly including drive means being operative in response to rotation of one of said upper posts to effect simultaneous vertical adjustment of the other of said upper posts with respect to said hold-down means whereby to regulate the degree of tightening of said head with respect to the sound chamber, and each said lower post including vertical adjustment means beneath said respective upper post operative to vertically adjust said respective upper post member independently of said other upper and lower post members to individually adjust the degree of tightening of said head in an area adjacent to said respective upper post member.

2. In a percussion instrument according to claim 1, said slotted portion of said post-receiving opening provided with a limited entrance to require vertical adjustment of said upper post to a point raising said enlarged cap above the upper surface of said hold-down means before the post can be laterally inserted into or removed from said opening.

3. In a percussion instrument according to claim 1, each opening in said hold-down means extending in a direction substantially tangential to the ring-like member, and a recessed portion in the form of an annular groove at the upper end of each said opening.

4. In a percussion instrument according to claim 1, said hold-down means being in the form of a circular band of generally inverted L-shaped configuration having a portion of the band overlying said ring-like member, and said post-receiving openings positioned in flanges affixed at spaced circumferential intervals to said band.

5. In a percussion instrument according to claim 1, wherein said drive means interconnect said tuning units to impart turning of one of said upper posts to said upper posts of each of said other tuning units.

6. In a percussion instrument having a removable head, an outer annular head support adapted to place said head over the upper circular edge of a bowl defining a sound chamber, the improvement comprising:

hold-down means associated with said outer head support adapted to adjustably dispose said head under varying degrees of tension over the upper circular edge of said bowl, said hold-down means including post-receiving openings at circumferentially spaced intervals;

a tuning system including a plurality of tuning units at intervals corresponding to the spacing and location of said post-receiving openings, each unit having a main frame affixed to the external surface of said bowl, upper and lower spaced horizontally extending arms on said frame providing upper and lower vertically aligned openings;

each tuning unit including upper and lower telescoping post members, each said upper telescoping post member extending through a post-receiving opening and adjustably connected to one of said lower post members, rotatable adjustment means on said upper telescoping post members for rotating said upper telescoping members independently of said respective lower telescoping post members, the rotation of said upper telescoping post members causing movement of said head with respect to the bowl, and vertical adjustment means on each of said lower post members, each said vertical adjustment means operative to vertically adjust its associated lower post member and connected upper post member independently of the other of said upper and lower post members; and means drivingly interconnecting said tuning units whereby to impart rotation of one of said upper telescoping post members only in response to adjustment by said rotatable adjustment means to said upper telescoping post members of each of said tuning units.

7. In a percussion instrument according to claim 6, each of said upper telescoping post members being defined by a post terminating in an enlarged cap at its upper end, said post being laterally insertable into a post-receiving opening with said cap at its in an enlarged recess communicating with the opening, bearing means mounted on said post between said cap and said recess, said bearing means being operative in response to rotation of said post to permit vertical adjustment of said post with respect to said hold-down means whereby to regulate the degree of tightening of said head with respect to the sound chamber.

8. In a percussion instrument according to claim 7, said post-receiving opening provided with a limited entrance to require vertical adjustment of said post to a point raising its enlarged head above the upper surface of said hold-down means before the post can be laterally inserted into said opening.

9. In a percussion instrument according to claim 8, said recess being formed in the upper surface of said hold-down means in surrounding relation to said post-receiving opening.

10. In a percussion instrument according to claim 6, said hold-down means being in the form of a circular band of generally inverted L-shaped configuration having a portion of the band overlying said head support, and said post-receiving openings positioned in flanges affixed at spaced circumferential intervals to said band.

11. In a timpani having a bowl terminating in an upper circular edge, a removable head positioned across the upper end of said bowl and terminating in an outer surrounding edge overlying the upper circular edge of said bowl, and a hoop affixed to the outer surrounding edge of said head, the combination therewith of:

a hoop retainer ring releasably engageable with said hoop, a plurality of open-throated hoop receivers at spaced circumferential intervals around the external surface of said hoop retainer ring, each hoop receiver including a laterally directed opening therein terminating in an upper enlarged slotted portion;

a tuning system including a plurality of tuning units, each unit having a main frame affixed to the external surface of said bowl and upper and lower spaced horizontally extending arms providing upper and lower vertically aligned post-receiving openings, a tuning post assembly for each tuning unit including upper and lower telescoping post members, there being a post member extending through each opening, means for turning said upper post member independently of said lower post member of each tuning unit, the turning of said upper post member causing movement of said head with respect to said bowl; and first adjusting means associated with said upper post members defined by a chain drive including chain sprockets associated with each of said upper post members and a chain interconnecting said sprockets whereby rotation of one of said upper post members on one tuning unit will impart corresponding rotation to said upper post members of each of said other tuning units, and second adjusting means for vertically adjusting each of said lower post members to simultaneously vertically adjust said upper post members in each of said respective tuning units to individually adjust the tension of said head in an area adjacent to said respective tuning unit.

12. In a timpani according to claim 11, said lower post member being in the form of a threaded rod extending upwardly into an internally threaded sleeve at the lower end of each upper post member, and said second adjusting means defined by means on said main frame engageable with a vertical slot in said rod to prevent rotation of said rod and an adjusting nut threadedly engageable with said rod and fixed against axial movement so that threaded adjustment of said rod will impart axial movement to said rod.

13. In a timpani according to claim 11, each said upper post member provided with vertically spaced alignment marks movable past an index point on said main frame to indicate the degree of vertical adjustment of each respective upper post member.

14. In a timpani according to claim 11, each upper post member terminating in an enlarged cap at its upper extremity having a socket adapted to receive an allen wrench for rotatable adjustment of said upper post member.

* * * * *